US005993168A

United States Patent [19]

Erkkilae et al.

[11] Patent Number: 5,993,168

[45] Date of Patent: Nov. 30, 1999

[54] SETTABLE CHOKE DEVICE TO CONTROL THE POWER SETTING OF A VARIABLE DISPLACEMENT HYRAULIC PUMP

[75] Inventors: Mikko Erkkilae, Horb; Felix zu Hohenlohe, Lohr/Main, both of Germany

[73] Assignee: Brueninghaus Hydromatik GmbH, Germany

[21] Appl. No.: 08/894,078

[22] PCT Filed: May 9, 1996

[86] PCT No.: PCT/EP96/01970

§ 371 Date: Aug. 12, 1997

§ 102(e) Date: Aug. 12, 1997

[87] PCT Pub. No.: WO96/36813

PCT Pub. Date: Nov. 21, 1996

[30] Foreign Application Priority Data

May 16, 1995 [DE] Germany ..... 195 17 974

[51] Int. Cl.[6] ..... F04B 49/00

[52] U.S. Cl. ..... 417/213; 417/222.1; 60/452

[58] Field of Search ..... 417/222.1, 213; 60/452

[56] References Cited

U.S. PATENT DOCUMENTS

| | | | |
|---|---|---|---|
| 3,957,396 | 5/1976 | Cooper . | |
| 4,404,009 | 9/1983 | Zeuner et al. | 60/452 |
| 4,668,171 | 5/1987 | Beutler et al. | 417/213 |
| 4,802,336 | 2/1989 | Mayr et al. | 60/452 |
| 5,460,000 | 10/1995 | Kropp | 60/452 |

FOREIGN PATENT DOCUMENTS

| | | | |
|---|---|---|---|
| WO 9312342 | 6/1993 | European Pat. Off. | 417/222.1 |
| 2042219 | 9/1980 | United Kingdom | 60/452 |

*Primary Examiner*—Timothy S. Thorpe
*Assistant Examiner*—Cheryl J. Tyler
*Attorney, Agent, or Firm*—Scully, Scott, Murphy & Presser

[57] ABSTRACT

A power or moment regulation device for an adjustable hydraulic pump having a servo setting apparatus providing for a smooth stepless setting of the pump delivery quantity. In the device, the delivery quantity setting is determined in dependence upon the delivery pressure of the hydraulic pump in a delivery pressure line and a control pressure in a control line. The setting apparatus has a spring setting a pump setting member in the direction of maximum delivery quantity and a piston acting upon the pump setting member in the opposite direction of delivery quantity reduction. The piston is acted upon via a hydraulically actuated control valve with the delivery pressure. The actuation of the control valve is effected by the control pressure in the control line. A moment valve is provided, the closure force of which is determined by a metering spring arrangement connected with the pump setting member and biased in dependence upon the delivery quantity setting. The moment valve connects the control line with a discharge in dependence upon the control pressure in the control line and the biasing of the metering spring arrangement. A settable choke device, for setting the control pressure acting upon the control valve and the moment valve, is arranged in the control line branching off from the operating pressure line of the pump.

12 Claims, 4 Drawing Sheets

SETTABLE CHOKE DEVICE TO CONTROL THE POWER SETTING OF A VARIABLE DISPLACEMENT HYRAULIC PUMP

BACKGROUND OF THE INVENTION

1. Field of the Invention

The present invention relates to a power or moment regulation device for an adjustable hydraulic pump having a hydraulic servo setting apparatus for providing for a smooth stepless setting of the pump delivery quantity. In the device, the delivery quantity setting is determined in dependence upon the delivery pressure of the hydraulic pump in a delivery pressure line and a control pressure in a control line. The setting apparatus has a spring setting the pump setting member in the direction of maximum delivery quantity and at least one piston acting upon the pump setting member in the direction of delivery quantity reduction. The piston can be acted upon via a hydraulically actuated control valve with the delivery pressure or is connected with a discharge. The actuation of the control valve is effected by means of the control pressure in the control line, whereby a moment valve is provided the closure force of which is determined by a metering spring arrangement which is connected with the pump setting member and is biased in dependence upon the delivery quantity setting. The moment valve connects the control line with the discharge in dependence upon the control pressure in the control line and the biasing of the metering spring arrangement.

2. Description of the Prior Art

Such a regulation device is known from EP 0 149 787. This known regulation device is operable either as a moment regulator or as power regulator, in dependence upon whether or not a delivery flow choke, which may be adjustable, is provided in the delivery pressure line of the hydraulic pump. With such regulation devices there is a direct functional relationship between the stroke volume of the pump and the load-dependent operating pressure upon which the control pressure acting upon the control valve is dependent. For moment regulation there applies the relationship that the product of operating pressure and stroke volume of the pump must be constant. If the speed of rotation of the pump is constant, moment regulation is at the same time power regulation. With power regulators, changes in the speed of rotation of the pump, which affect for example the delivery flow quantity, are additionally detected and regulated. A measure for the stroke volume of the hydraulic pump is the setting of the pump setting member which sets the pump delivery quantity, which is connected via a metering spring arrangement with the moment valve. The shape of the hyperbolic moment or power characteristic is determined solely by the configuration of the characteristic of the metering spring arrangement.

This known power or moment regulation device is very strongly dependent upon the operating delivery quantity taken on the load side from the operating pressure line. Upon an alteration of the operating delivery quantity, the control oil quantity in the control line also changes, so that the pump is displaced along its power hyperbola. A change of the position of the power hyperbola, that is a change of the power setting of the pump, is possible only via the direct adjustment of the biasing of the metering spring arrangement by manual means. This adjustment by hand is very inconvenient and complex. In particular applications, for example in excavator vehicles or the like, it is however necessary to be able to alter the power setting of the pump in dependence upon the kind of work being undertaken or in dependence upon the speed of rotation of the diesel motor driving the pump.

BRIEF SUMMARY OF THE INVENTION

Thus, an object of the present invention lies in the provision of a power or moment regulation device for an adjustable hydraulic pump having a hydraulic servo setting apparatus providing for smooth stepless setting of the pump delivery quantity. In the device, the delivery quantity setting is determined in dependence upon the delivery pressure of the hydraulic pump in a delivery pressure line and a control pressure in a control line. The setting apparatus has a spring urging a pump setting member in a first direction of maximum delivery quantity and at least one piston urging the pump setting member in a second opposite direction of delivery quantity reduction. The piston is acted upon via a hydraulically actuated control valve with the delivery pressure. The actuation of the control valve is effected by the control pressure in the control line. A moment valve is provided, the closure force of which is determined by a metering spring arrangement which is connected with the pump setting member and is biased in dependence upon the delivery quantity setting. The arrangement is such that the moment valve connects the control line with the discharge in dependence upon the control pressure in the control line and the biasing of the metering spring arrangement. In this arrangement, the moment or power setting of the hydraulic pump can be altered by simple manner and means and can be adapted to changing working conditions or to different loads.

This object is achieved by means of a power or moment regulation device in which the delivery pressure line branches into at least two operating pressure lines, from each of which a respective control line branches off. In each of the control lines, a respective choke device is provided, and the control lines are selectively connectable with the control line by a selection valve. Each settable choke device can be an electrical quantity-proportional valve, and can include a switch valve and choke arranged in parallel thereto. In greater detail, a choke can be arranged in the control line between the settable choke device or the selection valve and the branch to the control valve and to the moment valve. A delivery flow choke, which may be adjustable, is arranged in the delivery pressure line, and the control pressure and the delivery pressure are taken off respectively downstream and upstream of the delivery flow choke. Each settable choke device can be connected with a control device, by which different modes of operation of the hydraulic pump can be selected by a separate switch.

By means of the present invention it is thereby in particular possible to alter the control pressure in the control line by means of corresponding setting of the settable choke device, even when the operating delivery quantity taken on the load side out of the operating pressure line is to remain constant. Thereby, the power setting of the adjustable hydraulic pump can be adapted quickly and in simple manner to differing working conditions.

The settable choke device preferably consists of the electrically controlled quantity-proportional valve, through which the control pressure in the control line can be steplessly or smoothly set. By means of this configuration it is possible in an advantageous manner to separately alter the power setting of the pump, for example through actuation of a switch in the drivers cab of the excavator.

In the closed position of the control valve, the delivery flow regulation and the power regulation are switched off. In the working position of the quantity-proportional valve, delivery flow and power regulation are adjustable in the same manner.

In a further configuration, the settable throttle device is formed of a switch valve and a choke arranged parallel thereto. In this case, the power and the delivery flow regulation are effective also with the switch valve in closed position. In this exemplary embodiment there may be arranged a further choke in the control line, between the settable choke device, that is the switch valve and the choke parallel thereto, and the branch to the control valve and to the moment valve.

In a further configuration there is arranged in the delivery pressure line an adjustable delivery flow choke, between the hydraulic pump and the branch of the control line. By means of this adjustable delivery flow choke, variations in speed of rotation of the pump, which have effect on the delivery flow quantity, are, inter alia, detected by the regulator in accordance with the invention, which thus functions as power regulator. If the adjustable delivery flow choke is not provided in the delivery pressure line, the regulator in accordance with the invention represents a moment regulator.

Further, the settable choke device may be connected with a control device via which, by means of a separate switch, different modes of operation of the hydraulic pump can be set. By means of this configuration it is possible to adapt the power setting of the pump to the type of work been done in each case, by operation of the separate switch arranged for example in the drivers cab of an excavator. Thereby, the control device can additionally be connected with a device for measurement of the speed of rotation of the diesel, so that the power setting of the pump can also be controlled or adjusted in dependence upon the speed of rotation of the diesel.

BRIEF DESCRIPTION OF THE INVENTION

The present invention will be described in more detail below, with reference to preferred exemplary embodiments and with reference to the accompanying drawings, which show:

FIG. 1 a first exemplary embodiment of a power or moment regulation device in accordance with the invention, in which the settable choke device is formed by a quantity-proportional valve, FIG. 2 a second exemplary embodiment of the power or moment regulation device in accordance with the invention, in which the settable choke device is formed by a switch valve and a choke parallel thereto, and FIG. 3 a schematic illustration of a further exemplary embodiment, in which the power setting of the pump can be altered by means of a separate switch and a control device, FIG. 4 a further exemplary embodiment of the present invention, in which two operating pressure lines are provided with respective adjustable choke devices, which have effect selectively on the power or moment regulation device in accordance with the invention.

DETAILED DESCRIPTION OF THE INVENTION

Figure 1:
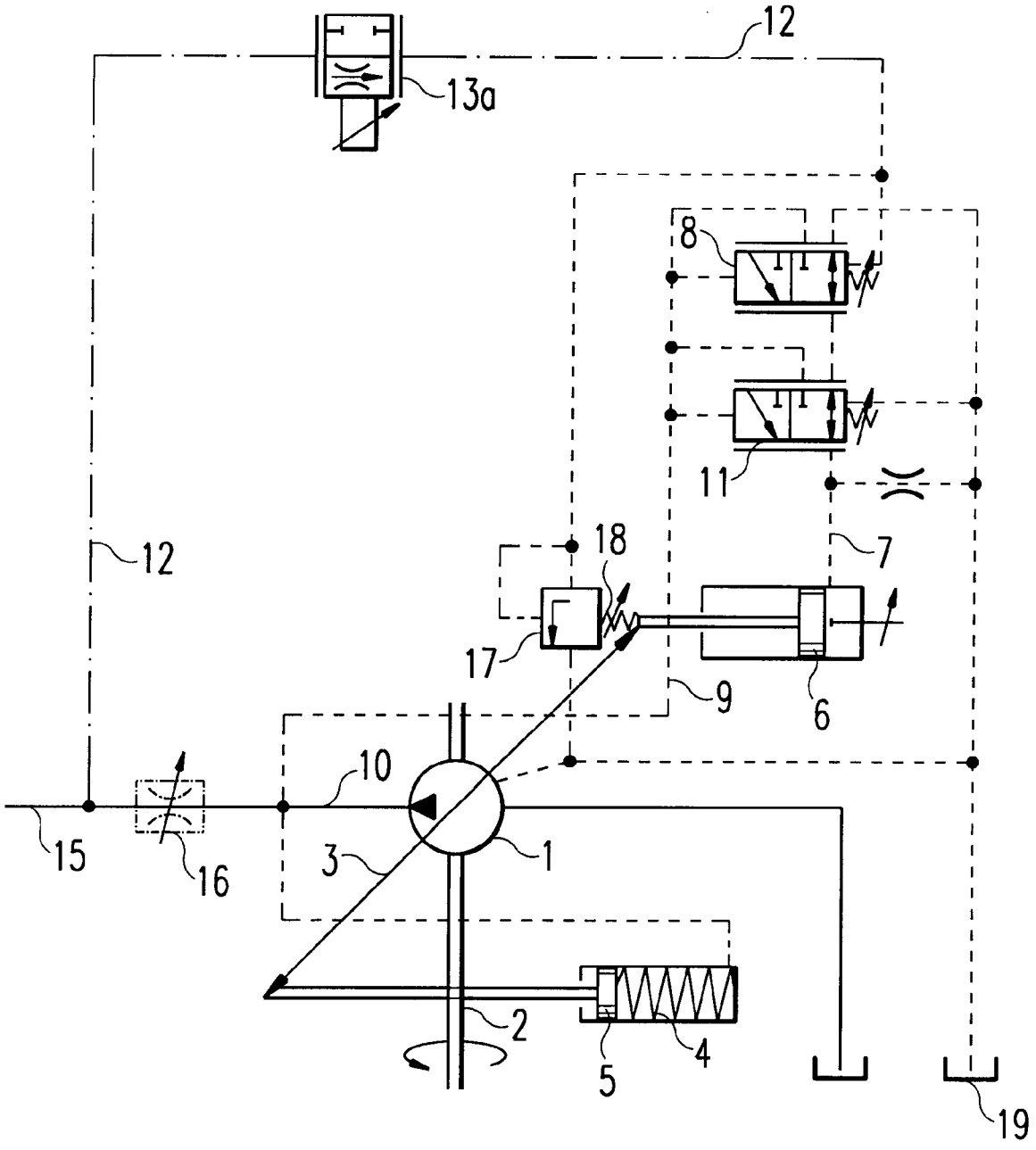

FIG. 1 shows a hydraulic pump 1 which is driven via a shaft 2 by means of a drive source which is not illustrated. The hydraulic pump 1 may be for example an adjustable axial piston pump which has a pump setting member 3 the tilt angle of which is proportional to the stroke volume of the hydraulic pump 1. A servo setting apparatus for the setting of the tilt angle of the hydraulic pump includes a spring 4 and a piston 5, acted upon by pressure, whereby the spring 4 adjusts the hydraulic pump 1 to a maximum tilt angle, that is to maximum delivery volume. A piston 6, which may be functionally integrated with the piston 5, assumes the return function in the direction of smaller tilt angles. The piston surface of the piston 6 is substantially larger than that of the piston 5. The setting pressure of a setting pressure line 7, acting on the piston 6, or on its piston surface, is taken off via a control valve 8 and the line 9 from the delivery pressure line 10 of the hydraulic pump 1. A pressure limiting valve 11 is connected in series with the control valve. The control valve is configured as a pressure balance and can thus also be described as a pressure control valve and is acted upon on the one hand by the delivery pressure of the line 9 and on the other hand by a control pressure of a control line 12. The control pressure or the control oil quantity in the control line 12 is settable via a settable choke device 13 which is arranged in the control line 12. The control line 12 takes off the load-dependent operating pressure of the hydraulic pump 1 from an operating pressure line 15 behind a delivery flow choke 16, which may be adjustable. The control oil quantity of the control line can thus be altered, in a simple manner and way, by means of the settable choke device 13. The delivery flow choke 16, which may be settable, limits the delivery flow of the hydraulic pump 1 in the delivery pressure line 10. In the configuration shown in FIG. 1, the delivery pressure and the control pressure, which act upon the control valve 8, are taken off before and behind the delivery flow choke 16. Thus, in this case a power regulator is involved. If the delivery flow choke 16 is not present, one has a moment regulator.

The moment valve 17 is on the one hand acted upon by the pressure of the control line 12 and on the other hand by a metering spring arrangement 18, the biasing of which is determined by the setting of the piston 6 or of the pump setting member 3. The moment valve 17 may connect the control line 12 with a pressure-less discharge. If the control pressure in the control line 12 attains the value set at the moment valve 17, this discharge begins to open and there arises a pressure drop at the control slide of the control valve 8. The control valve 8 is opened and the piston 6 acted upon, via the setting pressure line 7, with a control pressure and the piston, or the pump setting member 3, is displaced in the direction of smaller delivery quantity. Thereby, at the same time, the metering spring arrangement 18 of the moment valve 17 is biased, so that the pump is adjusted along the power hyperbola.

In the first exemplary embodiment shown in FIG. 1 the adjustable choke device 13 is formed by means of a quantity-proportional valve 13*a,* which for example may be electrically controlled. In the closed position of the quantity-proportional valve 13*a,* power and delivery flow regulation are switched off.

Figure 2:
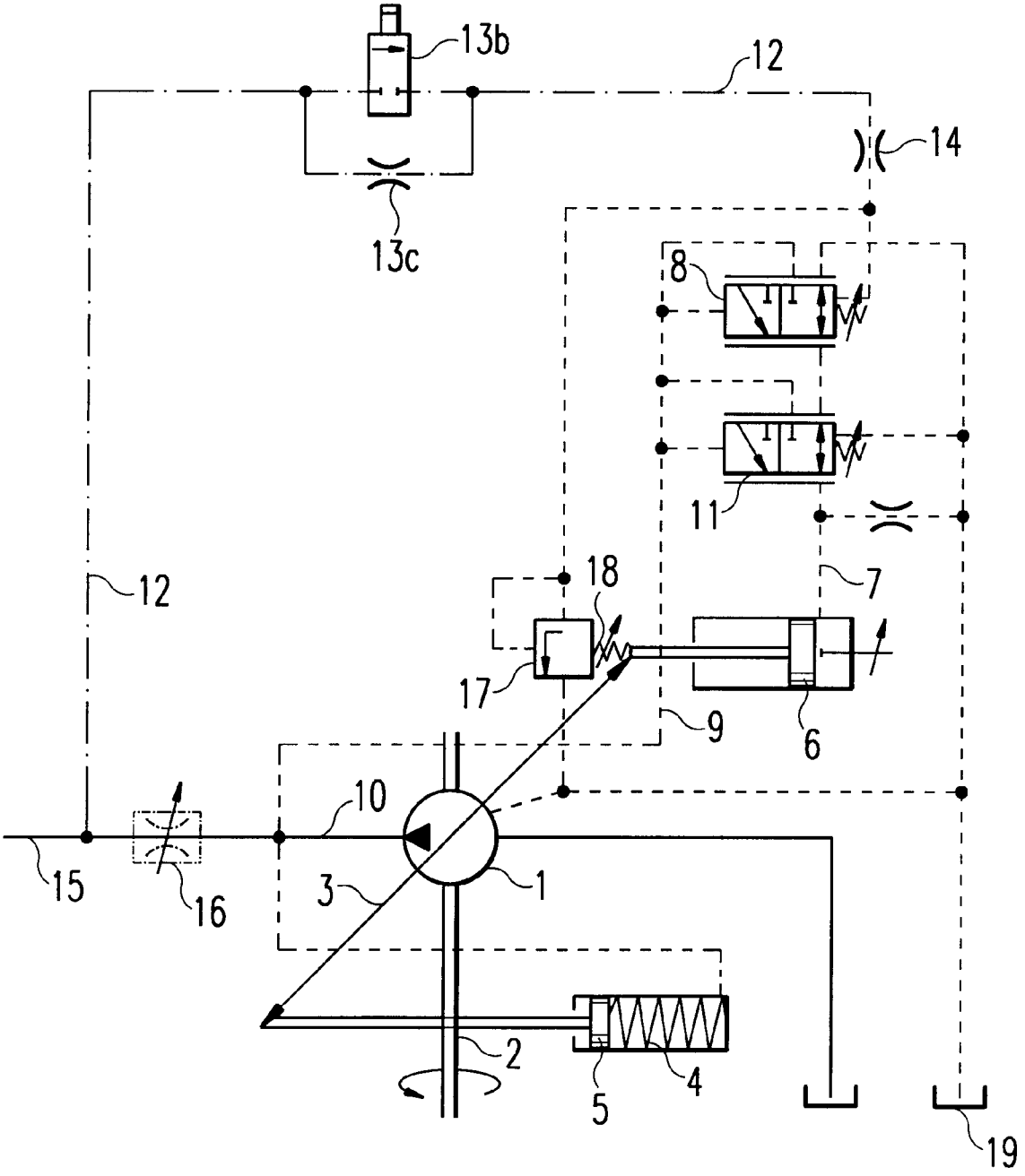

In the second exemplary embodiment shown in FIG. 2 the components corresponding to the first exemplary embodiment are provided with the same reference signs. The construction and manner of functioning of the second exemplary embodiment correspond to the construction and manner of functioning of the first exemplary embodiment. However, in the second exemplary embodiment, the settable choke device 13 is formed by means of a switch valve 13*b* and a choke 13*c* arranged parallel thereto. If appropriate, a further choke 14 may be provided between the choke device 13 and the branch of the control line 12 to the control valve 8 and to the moment valve 17. This further choke 14 limits the control oil quantity in the control line 12 when the switch valve 13*b* is located in the opened position.

Figure 3:
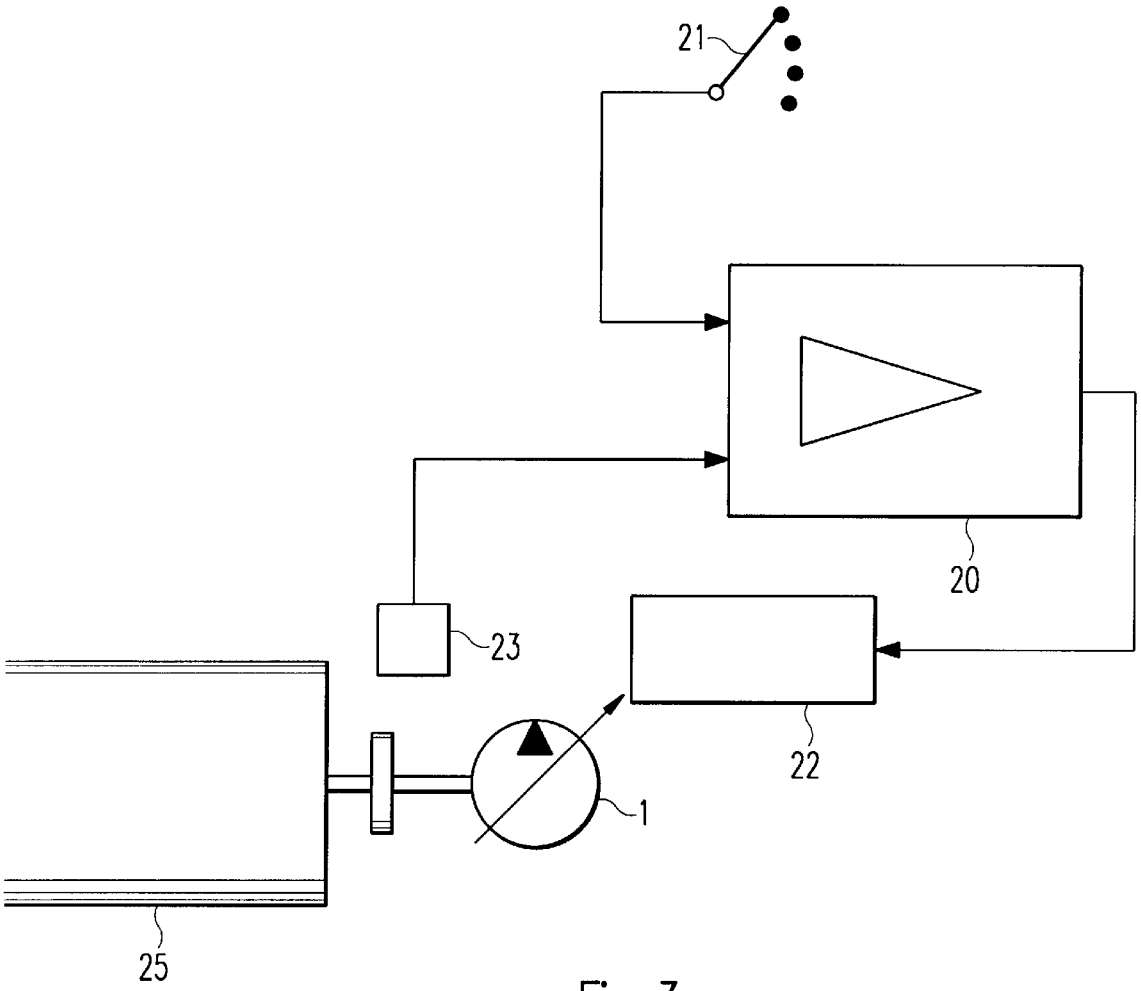

FIG. 3 shows a schematic overview of a further exemplary embodiment of the present invention. The settable choke device of the power or moment regulation device 22 of the pump 1 is connected with a control device 20 which is controllable by means of a separate switch 21. By appropriate setting of the switch 21 there can be set different modes of operation, that is power settings, of the pump. The illustrated switch 21 is discreetly adjustable, but a continuous mode of adjustment is also possible. Depending upon the type of work being done there can thus be provided different power settings of the pump 1. It is particularly favourable that the switch 21 is separately arranged for example in the drivers cab of an excavator. Further, there may be connected with the control device 20, a device 23 for measurement of the speed of rotation of the diesel motor 25 driving the pump 1. By this means it is possible to alter the power of the pump 1 in dependence upon the speed of rotation of the diesel motor, continuously or discreetly.

Figure 4:
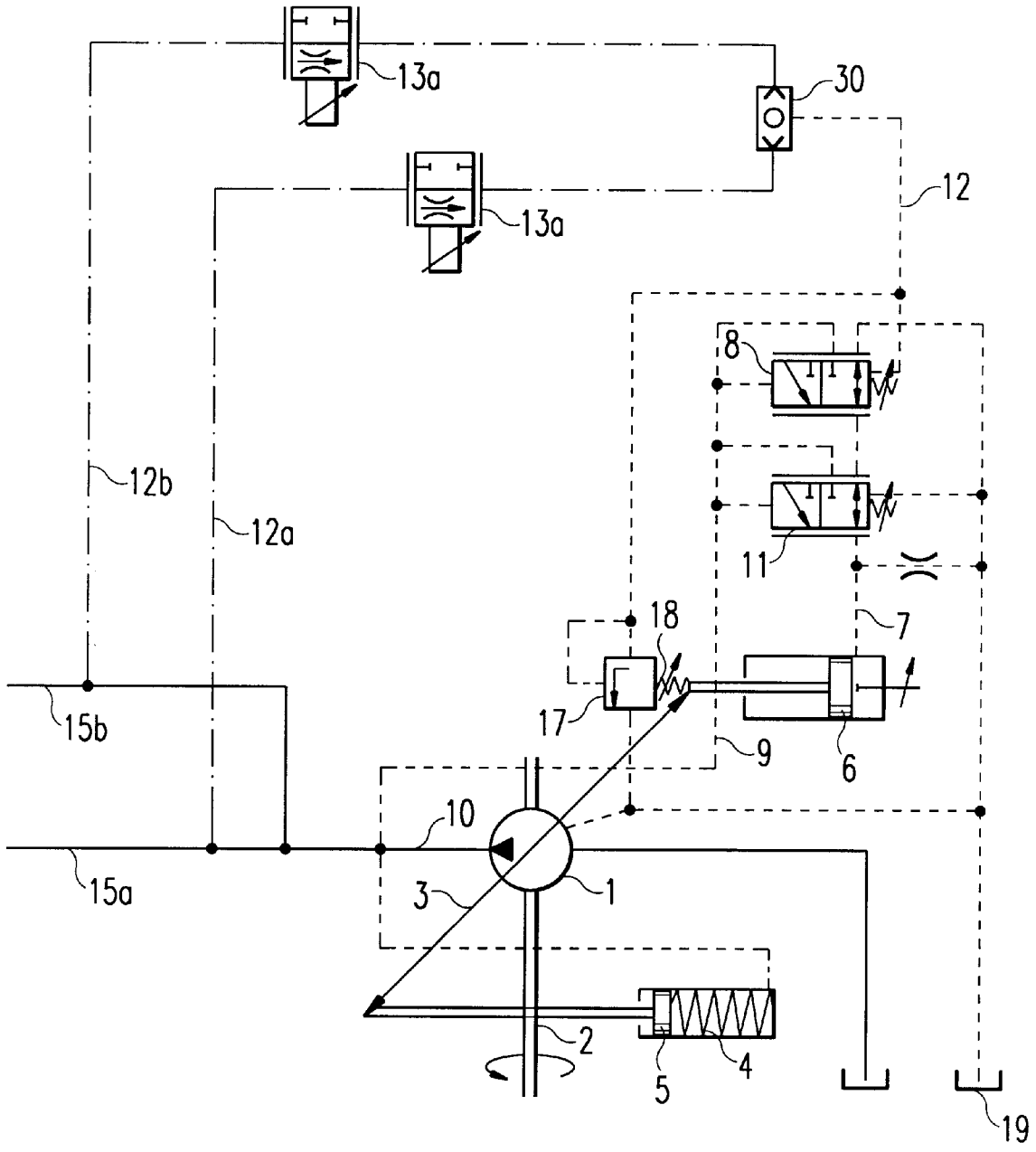

FIG. 4 shows a further exemplary embodiment of the present invention, in which the components corresponding to those of the exemplary embodiment shown in FIG. 1 are provided with the same reference signs. Differently from the first exemplary embodiment, in the exemplary embodiment shown in FIG. 4 two operating pressure lines 15*a,* 15*b* are provided, which branch off from the delivery pressure line 10. With the two operating pressure lines 15*a,* 15*b* different loads can be served, for example a loader block may be served by the operating pressure line 15*a* and an excavator block by means of the operating pressure line 15*b*. The number of operating pressure lines which branch off from the delivery pressure line 10 is, however, not limited to two as shown in the exemplary embodiment illustrated in FIG. 4; the delivery pressure line 10 can branch off into an arbitrary number of operating pressure line.

A control line 12*a* or 12*b* branches off from each operating pressure line 15*a,* 15*b*, in which control lines respective settable choke devices 13*a* are provided. The illustrated settable choke devices are electrically controllable quantity-proportional valves 13*a* in accordance with the exemplary embodiment shown in FIG. 1, but in the exemplary embodiment shown in FIG. 4 the settable choke devices may also be of a switch valve and a choke arranged parallel thereto, as in the second exemplary embodiment (FIG. 2). If more than two operating pressure lines are provided, a control line branches off from each of these operating pressure lines, in which control lines respective settable choke devices are provided. As shown in FIG. 4, the two control lines 12*a* , 12*b* are selectively or alternatively connectable with the control line 12 via a selection valve 30. The functioning and effect of the control line 12 has already been described in detail with reference to the first exemplary embodiment shown in FIG. 1.

Also with the exemplary embodiment shown in FIG. 4, correspondingly to the exemplary embodiments shown in FIGS. 1 and 2, a choke 14 may be arranged between the selection valve 30 and the branch of the control line 12 to the control valve 8 and to the moment valve 17. This choke 14 is, however, not shown in FIG. 4. Further, there can be arranged in the delivery pressure line 10 a delivery flow choke 16—which may be adjustable—whereby the control pressure and the delivery pressure are taken off respectively downstream of this choke 16 and upstream of this choke 16, analogously to the embodiment illustrated in FIG. 1. This, if appropriate adjustable, delivery flow chokes 16 is likewise not shown in FIG. 4. The settable choke devices 13*a,* 13*a* of the exemplary embodiment shown in FIG. 4 may, in accordance with the exemplary embodiment shown in FIG. 3, further be connected with respective control devices 20 via which—by means of a separate switch 21—different modes of operation of the hydraulic pump 1 can be set. Neither is this configuration shown in FIG. 4.

The operation of the selection valve 30, and therewith the selection of the operating pressure line 15*a,* 15*b* or load controlling the power or moment regulation in accordance with the invention, could likewise be effected by means of the control device 20.

We claim:

1. A regulation device for an adjustable hydraulic pump having a hydraulic servo setting apparatus for providing for smooth stepless setting of the pump delivery quantity, in which the delivery quantity setting is determined in dependence upon the delivery pressure of the hydraulic pump in a delivery pressure line and a control pressure in a control line, and the setting apparatus has a spring biasing a pump setting member in a first direction of maximum delivery quantity, and at least one piston urging the pump setting member in a second opposite direction of delivery quantity reduction, wherein the piston is acted upon via a hydraulically actuated control valve with the delivery pressure, and the actuation of the control valve is effected by the control pressure in the control line, wherein a moment valve is provided, the closure force of which is determined by a metering spring arrangement which is connected with the pump setting member and is biased in dependence upon the delivery quantity setting, wherein the moment valve connects the control line with the discharge in dependence upon the control pressure in the control line and the biasing of the metering spring arrangement, characterised in that, a settable choke device, for setting the control pressure acting upon the control valve and the moment valve, is arranged in the control line which branches off from the operating pressure line of the pump.

2. Regulation device according to claim 1, wherein the settable choke device comprises an electrical quantity-proportional valve.

3. Regulation device according to claim 1, wherein the settable choke device comprises a switch valve and choke arranged in parallel.

4. Regulation device according to claim 3, wherein a choke is arranged in the control line between the settable choke device and the branch to the control valve and to the moment valve.

5. Regulation device according to claim 1, wherein a delivery flow choke is arranged in the delivery pressure line, and the control pressure and the delivery pressure are taken off on respectively downstream and upstream sides of the delivery flow choke.

6. Regulation device according to claim 1, wherein the settable choke device is connected with a control device, by which different modes of operation of the hydraulic pump are selected by a separate switch.

7. A regulation device for an adjustable hydraulic pump having a hydraulic servo setting apparatus for providing for smooth stepless setting of the pump delivery quantity, in which the delivery quantity setting is determined in dependence upon the delivery pressure of the hydraulic pump in a delivery pressure line and a control pressure in a control line, and the setting apparatus has a spring biasing a pump member in a first direction of maximum delivery quantity, and at least one piston urging the pump setting member in a second opposite direction of delivery quantity reduction, wherein the piston is acted upon via a hydraulically actuated control valve via a hydraulically actuated control valve with the delivery pressure, and the actuation of the control valve is effected by the control pressure in the control line, wherein a moment valve is provided, the closure force of which is determined by a metering spring arrangement which is connected with the pump setting member and is biased in dependence upon the delivery quantity setting, wherein the moment valve connects the control line with the discharge in dependence upon the control pressure in the control line and the biasing of the metering spring arrangement, characterised in that, the delivery pressure line branches into at least two operating pressure lines, from each of which a separate control line branches off, and in each of which control lines a choke device is provided, and wherein the control lines are selectively connectable with the control line by a selection valve.

8. Regulation device according to claim 7, wherein each settable choke device comprises an electrical quantity-proportional valve.

9. Regulation device according to claim 7, wherein each settable choke device comprises a switch valve and choke arranged in parallel.

10. Regulation device according to claim 9, wherein a choke is arranged in the control line between the selection valve and the branch to the control valve and to the moment valve.

11. Regulation device according to claim 7, wherein a delivery flow choke is arranged in the delivery pressure line, and the control pressure and the delivery pressure are taken off on respectively downstream and upstream sides of the delivery flow choke.

12. Regulation device according to claim 7, wherein each settable choke device is connected with a control device, by which different modes of operation of the hydraulic pump are selected by a separate switch.

* * * * *